United States Patent [19]

Byrne

[11] Patent Number: 4,457,811

[45] Date of Patent: Jul. 3, 1984

[54] PROCESS FOR PRODUCING ELEMENTS FROM A FUSED BATH USING A METAL STRAP AND CERAMIC ELECTRODE BODY NONCONSUMABLE ELECTRODE ASSEMBLY

[75] Inventor: Stephen C. Byrne, Monroeville, Pa.

[73] Assignee: Aluminum Company of America, Pittsburgh, Pa.

[21] Appl. No.: 451,073

[22] Filed: Dec. 20, 1982

[51] Int. Cl.[3] ..... C25B 1/00; C25C 3/04; C25C 3/06; C25C 3/26

[52] U.S. Cl. ..... 204/60; 204/64 R; 204/64 T; 204/66; 204/67; 204/70; 204/286; 204/297 R

[58] Field of Search ..... 204/60, 64–71, 204/243 R, 286, 288, 297 R

[56] References Cited

U.S. PATENT DOCUMENTS

| | | | |
|---|---|---|---|
| 3,022,195 | 2/1962 | Hackley et al. | 117/123 |
| 3,152,871 | 10/1964 | Matchen | 29/195 |
| 3,284,174 | 11/1966 | Zimmer | 29/183.5 |
| 3,414,963 | 12/1968 | Cheng | 29/470.3 |
| 3,676,325 | 7/1972 | Smith et al. | 204/286 |
| 3,718,550 | 2/1973 | Klein | 204/67 |
| 3,839,779 | 10/1974 | Walker | 29/472.9 |
| 3,911,553 | 10/1975 | Burgess et al. | 228/173 |
| 3,915,369 | 10/1975 | Schmidt-Bruecken et al. | 228/194 |
| 3,960,678 | 6/1976 | Alder | 204/67 |
| 3,993,411 | 11/1976 | Babcock et al. | 403/271 |
| 3,994,430 | 11/1976 | Cusano et al. | 228/122 |
| 4,187,155 | 2/1980 | De Nora | 204/67 |

OTHER PUBLICATIONS

Billehaug, Kari and Øye, H. A., "Inert Anodes for Aluminum Electrolysis in Hall-Heroult Cells (I)", *Aluminium*, vol. 57, #2, 1981, pp. 146–150.

Billehaug, Kari and Øye, H. A., "Inert Anodes for Aluminum Electrolysis in Hall-Heroult Cells (II)", *Aluminium, vol. 57, #3, 1981, pp. 228–231.*

*Primary Examiner*—Howard S. Williams

*Attorney, Agent, or Firm*—Max L. Williamson

[57] ABSTRACT

A nonconsumable electrode assembly suitable for use in the production of metal by electrolytic reduction of a metal compound dissolved in a molten salt, the assembly comprising a ceramic electrode body and a metal subassembly of a metal conductor rod and at least one metal strap affixed to an end of the rod with opposing portions extending radially outwardly from the rod axis and having the ends of the strap attached to the electrode body.

25 Claims, 7 Drawing Figures

PROCESS FOR PRODUCING ELEMENTS FROM A FUSED BATH USING A METAL STRAP AND CERAMIC ELECTRODE BODY NONCONSUMABLE ELECTRODE ASSEMBLY

The Government has rights in this invention pursuant to Agreement No. DE-FC07-80CS40158 awarded by the U.S. Department of Energy.

BACKGROUND OF THE INVENTION

This invention relates to a method of connecting a metallic electrical conductor to an electrically conductive ceramic electrode body to make an electrode assembly which is suitable for use in producing metal by electrolysis.

A number of materials including silicon metals such as aluminum, lead, magnesium, zinc, zirconium, and titanium, for example, can be produced by electrolytic processes. Although individual processes may vary in some respects from one to another, each employs the use of an electrode which must operate in a highly corrosive environment.

An example of such a process for the production of metal is the well-known Hall-Heroult process (hereinafter referred to as the Hall process) for producing aluminum in which alumina dissolved in a molten fluoride salt bath is electrolyzed at temperatures from 900° C. to 1000° C. In the process as generally practiced today, carbon is used as an anode to reduce the alumina, and the reduction produces molten aluminum, and the carbon is oxidized to primarily form $CO_2$ which is given off as a gas. Despite the common usage of carbon as anode material in practicing the Hall process, there are a number of disadvantages to its use.

Since carbon is consumed in relatively large quantities in the Hall process, approximately 420 to 550 kg per ton of aluminum produced, the anode must be constantly repositioned or replenished to maintain the proper spacing with the cathode in the cell to produce aluminum efficiently. If prebaked anodes are used, it may be seen that a relatively large facility is needed to produce sufficient anodes to operate an aluminum smelter. Furthermore, to produce the purity of aluminum required to satisfy primary aluminum standards, the anode must be relatively pure carbon, and availability and cost of raw materials to make the carbon are of increasing concern to aluminum producers.

Because of the disadvantages inherent in the use of carbon as an anode, there has been a continuing search for inert or nonconsumable materials that can operate as an anode with a reasonable degree of electrochemical efficiency and withstand the high temperature and extremely corrosive environment of the molten salt bath. A number of different types of materials have been suggested and tried, including ceramic oxides, metals and ceramic transition metal borides and carbides, and gaseous fuels, such as natural gas or hydrogen, as the reactant in a fuel-cell type anode. From published literature, few, if any, materials tried will survive for a prolonged time in an aluminum electrolysis cell; however, some ceramic oxides have been reported to be corrosion resistant during cell operation. A recent review of literature and patents relating to inert anodes for use in producing aluminum may be found in articles entitled "Inert anodes for aluminum electrolysis in Hall-Heroult cells (I)" by Kari Billehaug and H. A. Øye, Volume 57, #2, *Aluminium,* 1981, and "Inert anodes for aluminum electrolysis in Hall-Heroult cells (II)" by Kari Billehaug and H. A. Øye, Volume 57, #3, *Aluminium,* 1981.

A major problem in the development and use of nonconsumable anodes for producing aluminum by electrolysis has been that of providing a satisfactory method for making a connection between an electrically conductive ceramic material and a metal conductor leading from the cell to a power source. In a typical operation of a Hall cell using carbon as the anode, the anode is formed into a block having a rectangular cross section and a metallic rod or bar is embedded therein by providing a hole in the block, inserting the rod in the hole and filling the void between the rod and the block with molten iron. When the iron solidifies, it shrinks tightly around the bar and away from the hole surfaces of the carbon block, but disengagement is prevented by adapting the block so as to engage the solidified iron. Such an adaptation is providing recesses in the hole side wall, for example. When the above-described assembly is positioned in a Hall cell having a salt bath which is maintained at approximately 1000° C., the rod, cast iron and carbon in the connection zone rise in temperature from room temperature to approximately 700° to 800° C. The rod, cast iron and carbon in the connection zone expand due to this temperature rise and a substantially tight and reasonably efficient electrical connection is effected. Because the rod and cast iron are relatively free to expand longitudinally, the principal electrical contact between the body and the metal due to the thermal expansion is along the lateral surfaces.

When ceramic materials are used for anode bodies, however, such a connection is not satisfactory for a number of reasons.

When using carbon as the anode body, it is desirable that it be in a block form because it is consumed during the electrolytic process and a large block or mass minimizes the frequency with which anodes must be replaced. It is not desirable, on the other hand, to provide an anode of ceramic materials in a large mass or block because, typically, ceramic anode bodies are more expensive to make than are carbon anode bodies, and the carbon materials are typically better conductors of electricity than are ceramic materials used in inert anodes.

As has been previously noted, the carbon anode to metal bar connection utilizing cast iron as the connecting medium relies primarily upon the lateral surfaces of the cast iron being in substantially tight contact with the lateral surfaces adjacent the hole in the carbon block to effect a reasonably satisfactory electrical connection. Variations in electrical conductivity of such a connection due to such things as irregularities in the cast iron and carbon block surfaces, for example, may be tolerated because of the relatively short time span over which an individual carbon block functions as an anode. In the case of an anode made from ceramic materials, however, most of the ceramic materials which are suitable for use as anodes are less efficient electrical conductors than carbon and, furthermore, to be effective, the anode must function over an extended period of cell operation time. Assuring a continuous intimate contact between the ceramic anode body and metal conductor is considered to be more critical, therefore, than the contact required between a carbon block and metal conductor.

Ideally, the connection of a nonconsumable anode material to a metal conductor for use in the electrolytic production of metal must be corrosion resistant, have a minimal voltage drop across the connection, and function to maintain the integrity of the ceramic material when subjected to temperature differentials on the order of 1000° C.

A number of methods for making connections of ceramic materials to metal conductors in the electrolytic production of aluminum have been proposed. Klein U.S. Pat. No. 3,718,550 proposes three different methods. In one of the methods, a ceramic anode tube, having a closed end, contains molten silver and a titanium carbide rod connected to a current supply extends down into the molten silver pool. In a second method, the inner surface of the tube is covered with a thin layer of silver or platinum and a hollow cylinder of nickel-alloy wire mesh is inserted into the tube to contact the silver or platinum layer and is connected with nickel-alloy wires to a conductor leading to the current supply. In the third method, the closed-end ceramic anode tube contains nickel powder, and a rod of zirconium diboride connected to a conductor leading to the current supply is inserted into the nickel powder. Alder U.S. Pat. No. 3,960,678 shows ceramic anode bodies of various shapes in contact with the electrolyte. Adjacent to the anode, but not in contact with the electrolyte, is a material designated as a current distributor which may be a metal such as Ni, Cu, Co, Mo or molten silver or a nonmetallic material such as a carbide, nitride or boride. Power leads connected to the current distributor may be made of the same materials, and it is suggested that the current distributor and power lead may be a single piece. The patentee does not describe how the various connections are to be made. De Nora et al U.S. Pat. No. 4,187,155 suggests attaching lead-in connectors to ceramic electrodes by fusing the connector into the electrode during the molding and sintering process or by making an attachment after sintering, but does not describe any method for making such attachments so as to avoid fracture of the ceramic in use.

Suggestions or descriptions for making metal bonds between ceramics and metals by welding, brazing or other methods of metal bonding have been made. Patents dealing with such methods, for example, are Hackley et al U.S. Pat. No. 3,022,195, Cheng U.S. Pat. No. 3,414,963, Matchen U.S Pat. No. 3,152,871, Zimmer U.S. Pat. No. 3,284,174, Walker U.S Pat. No. 3,839,779, Burgess et al U.S. Pat. No. 3,911,553, Schmidt-Bruecken et al U.S. Pat. No. 3,915,369, Babcock et al U.S. Pat. No. 3,993,411 and Cusano et al U.S. Pat. No. 3,994,430. None of these patents, however, are concerned with connecting an electrically conductive metallic oxide ceramic electrode body to a metal conductor for use in producing a metal by electrolysis. Heretofore, it has not been believed possible to make such a connection in producing a metal because of fracture or failure of the joint due to expansion and/or contraction of the assembly over the extreme temperature differential involved in production of metal by electrolysis.

It would be desirable, therefore, to provide a method for joining a ceramic body to a metal conductor for use in producing metal by electrolysis.

SUMMARY OF THE INVENTION

This invention is an assembly of a nonconsumable ceramic oxide electrode body and a subassembly comprising a metal conductor and at least one metal strap and the use of such an assembly in producing metal by electrolysis.

In this invention a nonconsumable ceramic electrode body is attached to a subassembly comprised of a metal conductor rod and at least one metal strap preferably by making a metallic connection between the electrode body and the metal strap. More preferably, a plurality of metal straps are used to provide optimum flexure of the straps in allowing for expansion and contraction of the subassembly due to operational temperature differentials in producing metal by electrolysis.

The subassembly is made by attaching at least one metal strap to an end of the metal conductor rod, preferably by making a metallic connection, such as welding, for example, but any method of attachment is suitable which provides an electrically conductive efficient connection between the rod and the strap.

The strap is attached to the end of the rod so as to have opposing portions project radially outwardly from the rod axis and provide a space between the electrode body and the subassembly after the ends of the strap are connected to the electrode body. For example, in one embodiment of this invention, a ceramic electrode body having an opening therein is provided and the electrode body surfaces adjacent the opening are at least partially lined with a coating of a conductive metal by any of a number of processes such as chemical vapor deposition, electroplate, etc. It is preferable that the lining cover all of the surfaces adjacent the opening to provide an electrically conductive current path that is evenly distributed throughout the entire electrode. As an alternative to lining the surfaces with a metal, at least a portion of the surface adjacent the opening of the ceramic body may be at least partially reduced to metal or metal alloy by contacting the surface with a suitable reducing agent and heating at a sufficient temperature for a sufficient time to effect such reduction of the ceramic body.

A metal conductor which may be in the form of a rod or bar has affixed to one end at least one and preferably a plurality of U-shaped straps of a metal composition that is suitable for attachment by a metallic connection with the metal lining or reduced surface of the opening. The U-shaped metal straps are attached to the end of the conductor in a manner that the legs of the U's project radially outwardly from the rod axis and upwardly around the conductor rod. The straps may be connected by welding or any other means that provides efficient conduction through the connection. The distance between the upstanding ends of the legs of the U's is preferably slightly greater than the distance between opposing walls of the opening if the opening is cube-shaped or slightly greater than the diameter of the opening if it is cylindrical. It is not essential that the distance across the space between the upstanding legs of the U be greater than the opening of the recess, but the distance should be no less to insure that the legs contact the wall surfaces adjacent the opening after inserting the end of the rod with the straps attached thereto into the opening.

To allow for movement of the rod and strap assembly due to temperature differentials, a space between the bottom of the opening and the assembly is provided and the straps may be attached to the metal lining or the reduced wall adjacent the opening by a mechanical connection such as a bolt, for example, but preferably by effecting a metal bond between the strap and the electrode body. By a "metal bond" is meant a bond between the metal strap and free metal or metal alloy in the reduced surface of the body or the metal lining adjacent the surface of the electrode body. Such a metal bond may be effected by welding, for example.

Thus a connection is made between the electrode body and the metal conductor which permits current flow through the metal straps to the electrode body and also provides for expansion and contraction of the metal without damage to the ceramic electrode.

In another embodiment of this invention, the ceramic electrode body may be provided without an opening and may be in the shape of a cylinder, block, plate, etc. The surface of the body to be connected to the metal subassembly is reduced to metal or metal alloy, or as an alternative, layered with a metal as described in the previous embodiment.

The subassembly in this embodiment is comprised of a metal conductor rod having at least one and preferably a plurality of metal straps projecting radially outwardly from an end of the rod, and the straps are formed so that the outwardly projecting portions extend downwardly and away from the rod. The ends of the straps are then connected to the reduced or metal layered surface of the electrode body, preferably by welding. Thus a space is provided between the electrode body and the subassembly to permit expansion of the subassembly without damage to the electrode body. The ceramic body may be comprised of any ceramic and/or combinations of metals and ceramics which are suitable for use as an electrode in a process for producing a metal by electrolysis and, if a connection is to be made to the subassembly by a metal bond, includes in at least the portion of the body to be connected to the metal conductor a level of free metal or metal alloy sufficient to effect a metal bond. Examples of such free metals or metals which may combine to produce free metal alloys are, for example, Fe, Ni, Al, Mg, Ca, Co, Si, Sn, Ti, Cr, Mn, Zr, Cu, Nb, Ta, Li, Y, Pt, Pd and Ir. It is to be understood that the word "ceramic" as used herein with reference to this invention is intended to include those combinations of ceramics and metals commonly referred to as cermets. In the practice of this invention, such free metal or metal alloy of such ceramic must have a higher melting temperature than the maximum temperature the ceramic body will be subject to during the operation of a cell in producing a particular metal by electrolysis. In producing aluminum, for example, ceramics which include Ni or NiFe as a free metal or metal alloy are suitable for use in an assembly of this invention, but the subject invention is not limited to the examples just cited. Further, the scope of this invention is intended to include any electrode body which may have a suitable ceramic layer as an exterior surface. For example, it has been suggested that an electrode might be made by flame spraying or plasma spraying a coating of ceramic material onto a base material such as titanium, nickel, copper, a carbide, a nitride, etc. Ceramic materials which have shown the best potential heretofore for use as inert electrodes in an electrolytic process for producing metal are metal oxides and combinations of metals and metal oxides called cermets, but it is not intended that this invention is limited to metal oxide and/or cermet materials.

The free metal or metal alloy may be provided by at least partially reducing by the use of a suitable reductant at least one of the metal compounds present in the ceramic body in an area where the metal bond is to be effected. Other methods of providing an essentially metallic connecting surface on the anode might also be suitable. For example, free metal might be provided in a cermet by introducing metal particles into a ceramic mixture prior to sintering. As an alternative, a layer of metal might be applied to the surface of the ceramic body to be connected by plating, plasma spraying or chemical vapor deposition, for example. After providing the metal in a manner proposed by the foregoing examples, a metal bond between the ceramic anode body and the metal subassembly can be made.

The metal conductor and U-shaped straps may be any metal that is suitable for use as a conductor in a particular electrolytic process, can be joined to the electrode body, and is compatible with the electrode in the cell environment. That is, no adverse reaction between the ceramic material and the metal arises from the connection of the two materials.

Mechanical support of the electrode assembly in the electrolytic cell may be through connecting the rod to an overhead conductor, such as a bus bar, for example. If additional support is required because of the weight of the assembly, a lip around the electrode body may be provided for assembly with a support structure.

It is an object of this invention to provide an electrically efficient, reliable, economical method of connecting a ceramic electrode body to a metal conductor for use in producing metal by electrolysis.

It is an advantage of this method that expansion and contraction of the conductor and electrode body can take place without fracture or failure of the ceramic body.

These and other objects and advantages of the invention will be more apparent with reference to the accompanying drawings and the following description of a preferred embodiment.

DESCRIPTION OF A PREFERRED EMBODIMENT

A description of an assembly will be made with reference to producing aluminum by the Hall process, but the scope of the invention is not intended to be limited to use of the assembly in the production of metals.

Figure 1:
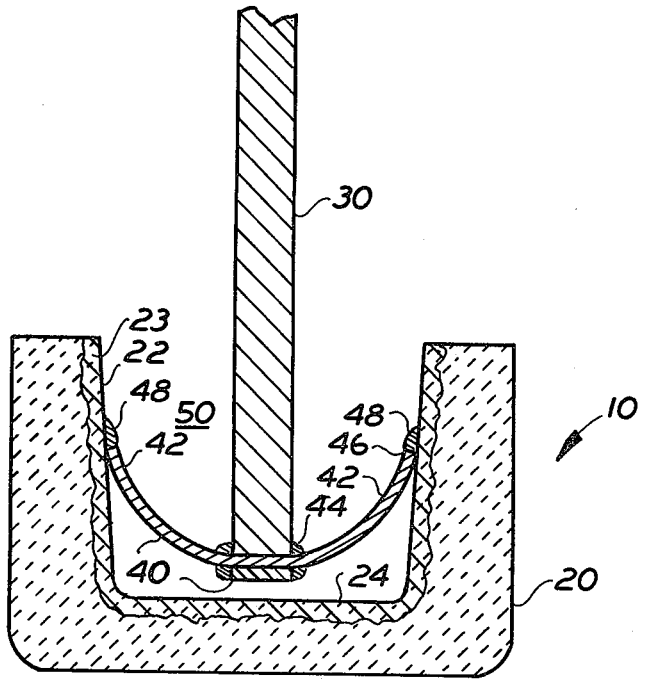
FIG. 1 is a cross-sectional view of a connection assembly of this invention.
Figure 2:
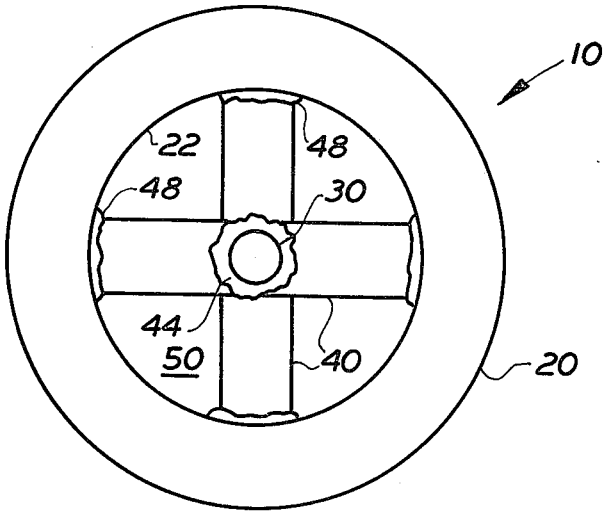
FIG. 2 is a top view of the assembly shown in cross section in FIG. 1.

An anode assembly 10 is shown in FIGS. 1 and 2 and is comprised of a ceramic metallic oxide anode body 20, a metal conductor rod 30 and U-shaped metal straps 40.

In this preferred embodiment, the anode body 20 is cup-shaped, but it is apparent that the body may be of any shape having an opening 50 therein. The body 20 is comprised of 20 wt. % Fe, 60 wt. % NiO and 20 wt. % $Fe_3O_4$ metallic oxides and is reaction sintered in an argon atmosphere at a temperature of approximately 1275° to 1350° C. for approximately four hours under a pressure of approximately 25,000 psi (172 MPa) to produce an interwoven network of metallic material and oxides, the metallic materials containing Ni-Fe alloy and the oxide material containing (Ni,Fe)O and $Ni_xFe_{3-x}O_4$. Prior to making an assembly 10 as shown in FIGS. 1 and 2, the interior surfaces 22, 24 of the anode body 20 adjacent the opening 50 are contacted with a reductant and heated at an appropriate temperature for a sufficient time to reduce metallic oxides at or adjacent the surface in a zone 23 to at least one metal or metal alloy. In this preferred embodiment, the opening 50 is filled with a carbonaceous material and heated to a temperature greater than 900° C. Since the extent of reduction is essentially a function of time and temperature, it is believed that the surface of the body could be completely reduced to a metal or metal alloy structure. For purposes of this invention, however, the extent of the reduction need be only that which produces a sufficient amount of metal to effect a bond between the anode body and metal straps and has adequate strength for its intended use. After reducing the surfaces 22, 24 of the anode as just described, the material at or adjacent to the surfaces in zone 23 is believed to be typically comprised of Ni, NiFe alloy as free metal and metal alloy in a ceramic matrix of (Ni,Fe)0 and $Ni_xFe_{3-x}O_4$. Surprisingly, in addition to providing the desired metal or metal alloy to effect an intermetallic connection, it has been discovered that the material in the reduced zone is less susceptible to fracture under stress such as that induced by the relatively large temperature differential involved in producing aluminum by the Hall process. Extending away from the reduced material zone 23 described above into the anode body is a transition zone of material of varying composition.

Also prior to making an assembly as shown in FIGS. 1 and 2, a subassembly of the nickel alloy 200 conductor rod 30 and metal straps 40 is made. The metal straps comprised of a nickel 200 (99.5% nickel) alloy are formed into a "U" shape having a distance between the upstanding legs 42, measured from the outer surfaces of the legs, at least equal to and preferably greater than the inside diameter of the opening 50. The number of straps 40 required is determined by current carrying requirements and the strength needed to support the weight of the anode body 20 when assembled to the straps. In this preferred embodiment, only two straps 40 are shown for ease of illustration. The straps 40 are assembled adjacent an end of the conductor rod by an inert gas welding method, preferably by TIG welding, using a nickel alloy filler rod as indicated by the weld bead 44.

After the conductor rod and metal strap subassembly has been made as just described, the subassembly is inserted into the opening 50 with an upper portion 46 of the strap 40 in intimate contact with the essentially cylindrical surface 22 of the anode body 20. The subassembly is positioned within the opening 50 so as to provide sufficient clearance between the subassembly and the bottom surface 24 of the opening to accommodate the anticipated vertical movement of the subassembly due to the temperature differential in the use for which it is intended.

After properly positioning the subassembly in the opening 50 as just described, the end portions 46 of the straps 40 are attached to the wall surface 22 of the anode body by TIG welding using a nickel alloy filler rod as shown by the weld beads 48.

Figure 3:
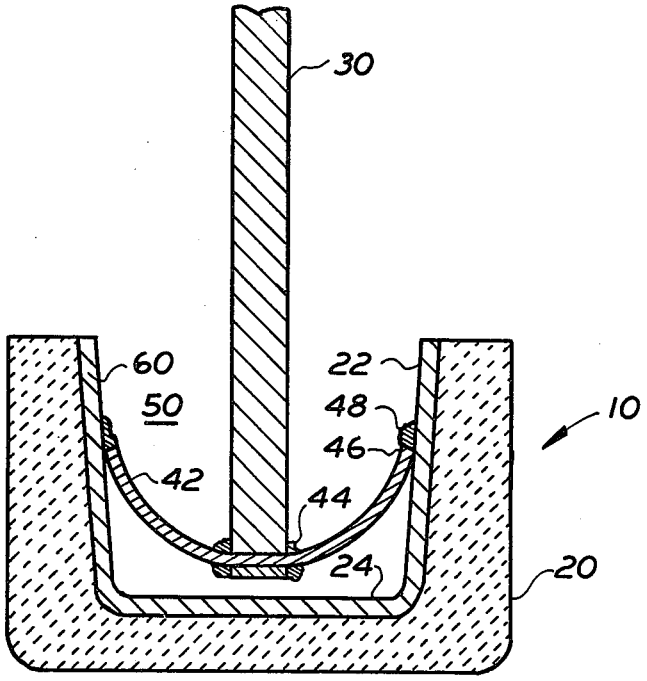
FIG. 3 is a cross-sectional view of an alternate embodiment of a connection assembly of this invention.
Figure 4:
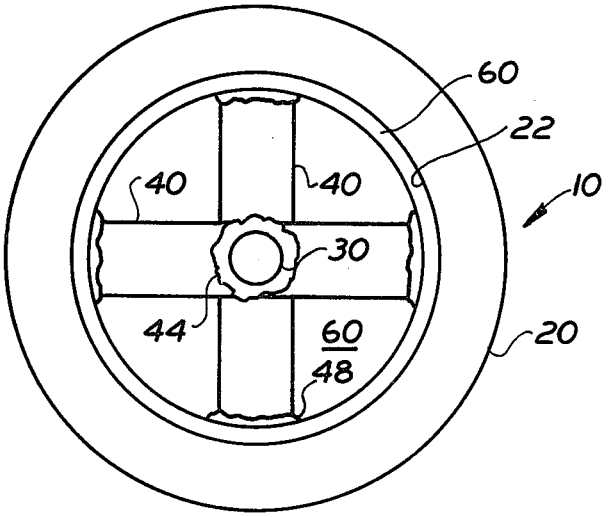
FIG. 4 is a top view of the assembly shown in cross section in FIG. 3.

In an alternate preferred embodiment as shown in FIGS. 3 and 4, the anode body 20 has a metal liner 60 in intimate contact with its interior surfaces adjacent the opening 50 rather than the reduced surface of the first described embodiment. To provide the liner 60, prior to making the assembly shown in FIGS. 3 and 4, the interior surfaces 22, 24 of the anode body are lined with a nickel liner by an electroless deposition or chemical vapor deposition method. The liner 60 is applied in a thickness of approximately 2 mm. Assembly of the anode body 20 to the conductor rod 30 and metal straps 40 is then made in the manner described in making the assembly of the first preferred embodiment.

Figure 5:
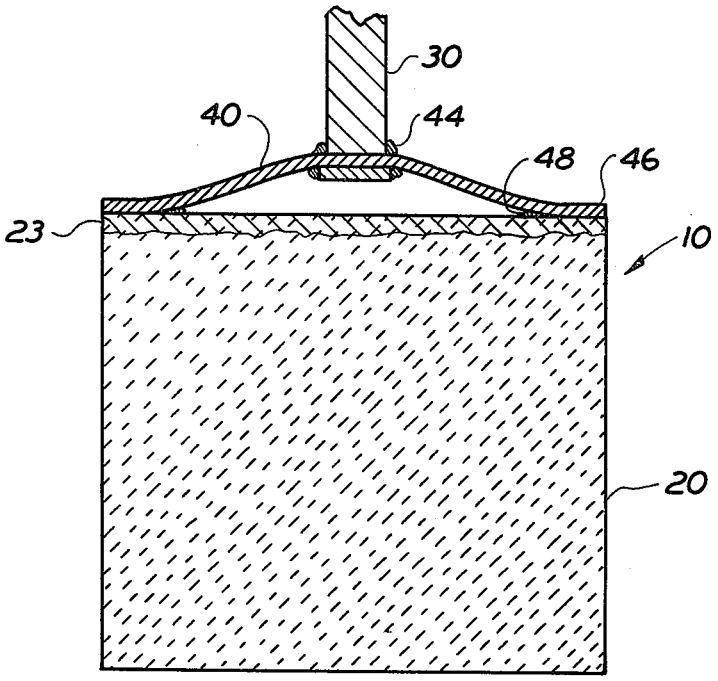
FIG. 5 is a cross-sectional view of an alternate embodiment of an assembly of this invention.
Figure 6:
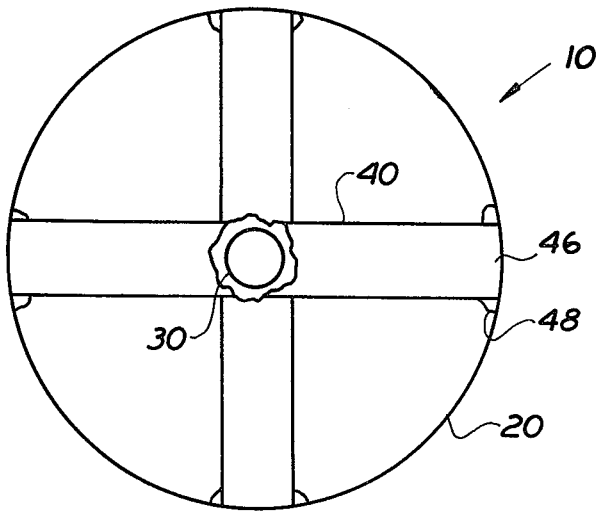
FIG. 6 is a top view of the assembly shown in cross section in FIG. 5.

An additional embodiment of this invention is shown in FIGS. 5 and 6. In this embodiment, the anode body 20 of the anode assembly 10 is a solid cylinder, but it may have some other cross-sectional shape, such as square or rectangular, if desired. At the top of the body is a zone of material 23 which includes free metal or metal alloy which is suitable and in an amount sufficient to effect a metal bond, by welding, for example. The free metal or metal alloy may be provided by reduction of the top surface, as has previously been described.

A subassembly is comprised of a metal conductor rod 30 having at least one metal strap 40 affixed to an end thereof, preferably by a weld 44. The outwardly extending portions of the strap 40 are bent downwardly from the end of the rod so as to provide a space between the anode body and the rod end having the strap affixed thereto so as to permit expansion and contraction of the subassembly without contacting the body 20. End portions 46 of the strap 40 are adapted to permit attachment of the subassembly to the top portion of the body 20 by a weld 48.

Figure 7:
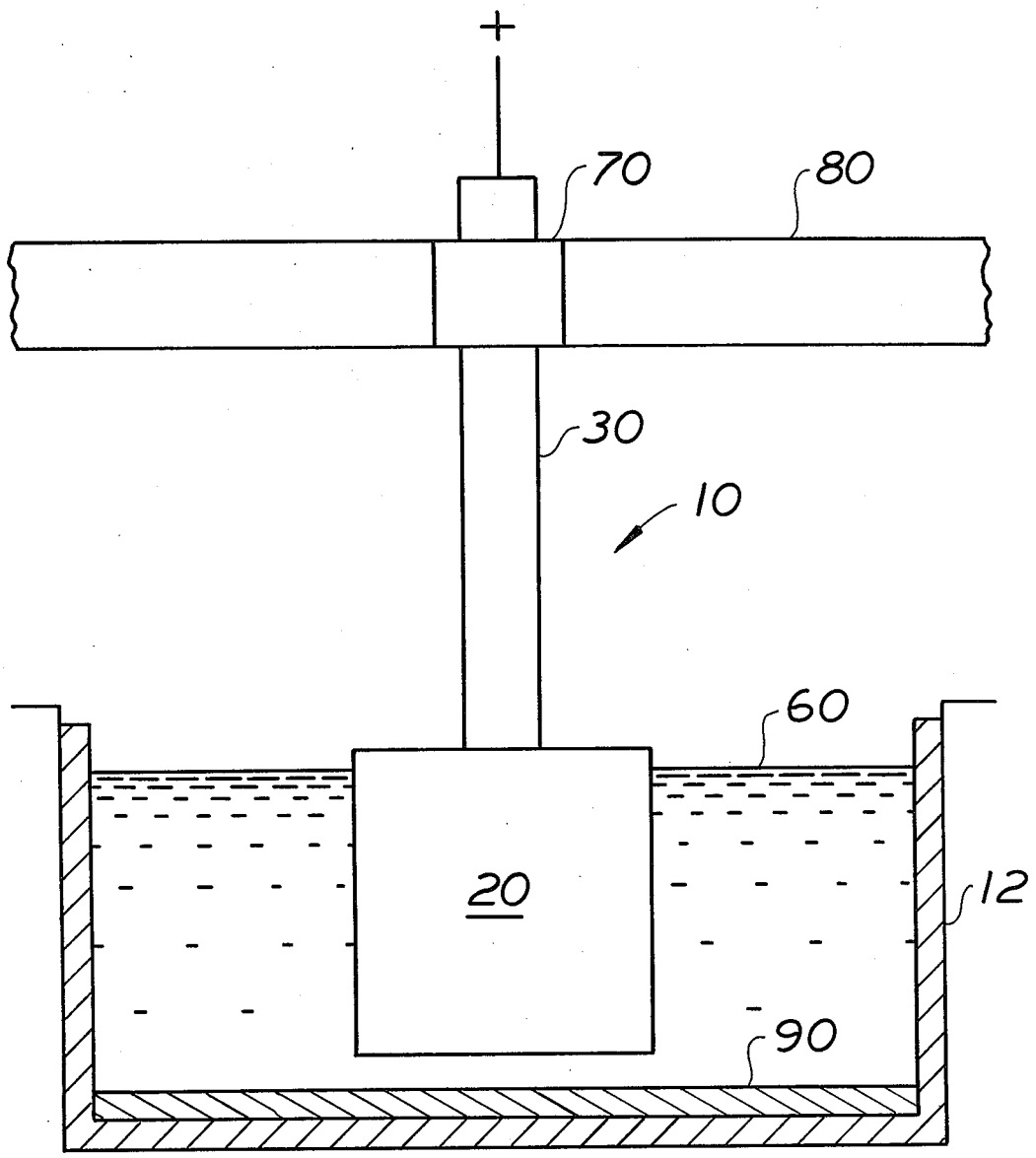
FIG. 7 is a cross-sectional view of a cell for producing aluminum by electrolysis with an assembly of this invention suspended therein.

Use of an assembly of this invention for producing aluminum by a typical electrolytic process is described with reference to FIG. 7. A container 12 suitable for containing a molten salt bath 60 is adapted as a cathode. Suitable cell materials and construction thereof are known to those skilled in the art.

The composition of the molten salt bath 60 is typically comprised of $Al_2O_3$ dissolved in a molten salt wherein the weight ratio of NaF to $AlF_3$ is maintained at approximately 1.1 and the salt bath further includes approximately 5 wt. % $CaF_2$ and 5 wt. % $Al_2O_3$. An anode assembly 10 of this invention as previously described is suspended in the molten salt bath by attaching the metal conductor 30 with a clamp 70 or other suitable suspension means known to those skilled in the art to a support means 80, and a positive lead from a power source is attached to the conductor 30. Preferably, the assembly 10 is suspended in the bath 60 with the upper edge of the anode body 20 above the level of the bath to minimize attack from the salt bath and products of electrolysis on the reduced interior of the body and the metal conductor 30.

In operating the cell, the bath 60 is maintained at approximately 960° C. and a current density of approximately 6.5 amps/in$^2$ (1 amp/cm$^2$) of surface area of the bottom of the anode body 10 is maintained with an anode-to-cathode distance of approximately 1½ inches (38 mm).

The process, when performed in such a manner, causes reduction of the dissolved $Al_2O_3$ with oxygen liberated at the anode 10 and molten aluminum 90 settling and collecting on the bottom of the cell 50.

The following examples are offered to further illustrate making a ceramic oxide body to metal conductor connection by a method of this invention.

EXAMPLE 1

The cup-shaped anode body of this first example was approximately 74 mm outside diameter and 68 mm high with an opening diameter of approximately 55 mm. The composition of the body was 51.3 wt. % NiO and 48.7 wt. % $Fe_3O_4$ which was sintered at a temperature of approximately 1425° C. for 16 hours under a pressure of approximately 20,000 psi (138 MPa). Prior to assembly, the interior surfaces of the cup were reduced by filling the cup with carbon mastic cement and heating to a temperature of 1000° C. in an argon atmosphere for 6 hours to produce a zone at and adjacent the surface having free metal and/or free metal alloy therein. Four U-shaped straps 0.050 inch thick by 0.25 inch wide of nickel alloy 200 were TIG welded to an end of a ⅜ inch diameter nickel alloy 200 rod using a nickel alloy welding rod, and the metal strap conductor rod subassembly was attached to the cup by TIG welding an upper portion of each metal strap leg to the reduced surface of the cup with a nickel alloy welding rod. A space of approximately 12 mm was provided between the bottom of the cup and the rod-strap subassembly to provide for expansion of the subassembly.

After making the anode assembly, the cup opening was filled with a metallic oxide powder of the same composition as the anode body and the powder was tamped tightly in place. A boron nitride cover plate having a central opening to accommodate the ⅜ inch diameter conductor rod was placed across the cup opening, and the seam between the cover plate and the rod, and the seam between the cover plate and the cup, were filled with a boron nitride paste.

Although not considered essential to the invention, in this example, the interior of the cup was filled with a ceramic powder and a boron nitride cover was provided because it was believed that the environment surrounding the bench scale cell was not adequate to provide the ready escape of undesirable electrolysis by-products.

The assembly was then suspended in the cell and the cell was operated for 103 hours with an average connection voltage drop of 0.62 volt.

Upon completion of the test, the assembly was examined and its general condition was noted as follows. Although the connection held, the cup had cracked across the bottom and the reduced surface on the bottom was oxidized.

EXAMPLE 2

In this example an anode assembly was prepared and tested in the same manner as described in Example 1.

After 55 hours of cell operation, the nickel rod burned off above the boron nitride cover plate from the corrosive effect of electrolysis products. During the period of operation, the average connection voltage drop was determined to be 0.32 volt.

EXAMPLE 3

In this example the composition of the anode cup was 20 wt. % Fe, 60 wt. % NiO and 20 wt. % $Fe_3O_4$. Prior to assembly, the cup was reaction sintered in an argon atmosphere at a temperature of approximately 1275° C. for approximately 4 hours under a pressure of approximately 25,000 psi (172 MPa) and the interior surfaces were reduced by filling the cup with carbon mastic cement and heating to a temperature of 1000° C. in an argon atmosphere for 5 hours to produce a zone at and adjacent the reduced surfaces having free metal and/or metal alloy therein. In this example only three U-shaped nickel alloy straps were used and the conductor rod was ½ inch diameter instead of ⅜ inch diameter as in the previous examples. In all other respects, the assembly was made as described in Example 1.

After assembly, the cup opening was filled and tamped with $Al_2O_3$ powder and a seal was effected by applying a layer of a high temperature ceramic adhesive identified as 503 cement and sold by Aremco Products, Inc. under the trademark "Ceramabond" over the $Al_2O_3$ powder and lip of the anode cup. It is believed that such cement is an $Al_2O_3$ base product.

The assembly was then suspended and tested as described in Example 1. After 24 hours of cell operation, the metal straps failed from reaction with the $Al_2O_3$ filler to give $NiAl_2O_4$ and the anode body fell into the bath. During the period of operation, the average connection voltage drop was 0.51 volt.

EXAMPLE 4

The assembly was prepared identically to Example 3 except that a ⅜ inch diameter conductor rod was used instead of a ½ inch diameter rod.

After 24 hours of cell operation, the metal straps of this assembly also failed due to oxidation. The average connection voltage drop during this test was 0.24 volt.

From an analysis of the results of the foregoing tests, it is concluded that an assembly of this invention is satisfactory for its effectiveness in providing an essentially low voltage drop across the connection. It may be seen from the examples that in each instance oxidation of one or more metallic components of the assembly adversely affected the duration of the test. It is believed that the life of the nickel components in a commercial cell would be satisfactory. It may be noted that the foregoing tests were bench scale, and by the nature of the bench scale tests, the assemblies were of a considerably smaller size than would be expected for use on a commercial scale. Further, the environment in which the bench scale tests were conducted did not permit the escape of vapors and products of electrolysis as would be expected in the environment surrounding a commercial cell. In operation of a commercial cell for producing aluminum and using a connection of this invention, for example, the anode body might be approximately 300 mm in diameter rather than the approximately 74–82 mm diameter of the anode bodies of the foregoing examples. With a larger anode body, it is apparent that the metal conductor and straps of the assembly would also increase substantially in size in order to structurally support the larger anode body and provide the necessary current carrying capacity. With larger cross-sectional area nickel components in the connection assembly, oxidation effects upon the nickel during the cell operation would be minimized, and it is believed that nickel components of sufficient cross-sectional area to provide adequate structural support and current carrying capacity in use in a production cell would eliminate the detrimental effects of nickel oxidation.

If considered necessary, the exposed nickel surfaces and exposed reduced surfaces of the anode might also be shielded by an inert gas such as nitrogen, for example. As one method of supplying the gas, the metal conductor rod could be provided as a tube having perforations therein connected to a source of gas under sufficient pressure to shield the cup interior and metal parts therein as the gas issued from the perforations.

Although solutions to the problem of corrosion of the metal components of a connection of this invention have been discussed with reference to nickel and production of aluminum by electrolysis, it is apparent that such solutions would be applicable to other metals to be used in the production of aluminum as well as in the production of other metals.

While the invention has been described in terms of preferred embodiments, the claims appended hereto are intended to encompass all embodiments which fall within the spirit of the invention.

What I claim is:

1. An assembly of a ceramic electrode body and a metal conductor rod for use in the production of an element selected from the group consisting of aluminum, lead, magnesium, zinc, zirconium, titanium and silicon by electrolytic reduction of a compound comprised of such element dissolved in a molten salt, the assembly comprising:

a ceramic electrode body;

a subassembly including a metal conductor rod having at least one metal strap affixed to an end of the rod and the strap having opposing portions extending radially outwardly from therod axis, the end of the rod and the strap portion affixed thereto spaced apart from said ceramic body a distance sufficient to avoid contact between said ceramic body and the affixed strap portion during said use of said assembly; and means for attaching end portions of the strap to said body.

2. An assembly as described in claim 1 wherein said body includes an opening therein, and said subassembly is spaced apart from an interior bottom surface within the opening of the body.

3. An assembly as described in claim 2 wherein said metal strap is U-shaped with the legs of the U projecting upwardly around the conductor rod.

4. An assembly as described in claim 1 wherein said ceramic body includes a portion for attachment to said strap, said body portion having a free metal or metal alloy therein.

5. An assembly as described in claim 4 wherein said attaching means is a metal bond connection.

6. An assembly as described in claim 4 wherein said attaching means is a weld.

7. An assembly as described in claim 4 wherein said body portion is a chemically reduced portion of said ceramic electrode body.

8. An assembly as described in claim 4 wherein said free metal or metal alloy is selected from the group consisting of Fe, Ni, Al, Mg, Ca, Co, Sn, Ti, Cr, Mn, Zr, Cu, Nb, Ta, Li, Y, Pt, Pd and Ir.

9. The assembly as described in claim 4 wherein said ceramic electrode body includes at least one metal oxide.

10. The assembly as described in claim 9 wherein said body portion is a chemically reduced portion of said ceramic electrode body.

11. The assembly as described in claim 4 wherein said ceramic electrode body includes at least one metal compound comprised of at least two metal oxides.

12. The assembly as described in claim 11 wherein said body portion is a chemically reduced portion of said ceramic electrode body.

13. An assembly of a ceramic electrode body and a metal conductor rod for use in the production of an element selected from the group consisting of aluminum, lead, magnesium, zinc, zirconium, titanium and silicon by electrolytic reduction of a compound comprised of such element dissolved in a molten salt, the assembly comprising:

a ceramic electrode body having an opening therein and at least a portion of said body having a free metal or metal alloy therein;

a subassembly comprised of a metal conductor rod having at least one U-shaped metal strap affixed to an end of the rod in a manner that the legs of the U project outwardly from the rod axis and upwardly around the rod, and the end and the strap portion affixed thereto spaced apart from an interior bottom surface of said opening a distance sufficient to avoid contact between the bottom surface and the affixed strap portion during said use of said assembly; and weld means for attaching the strap to the body.

14. A process for producing an element selected from the group consisting of aluminum, lead, magnesium, zinc, zirconium, titanium and silicon by electrolytic reduction of a compound comprised of such element dissolved in a molten salt, said process including providing a nonconsumable electrode assembly by the steps of:

providing a ceramic electrode body;

providing a subassembly comprised of a metal conductor rod having a portion of at least one metal strap affixed to an end of the rod, the strap having opposing portions extending radially outwardly from the rod axis and the strap adapted to provide a space between said ceramic body and the strap portion affixed to the rod end, the space sufficient to avoid contact between said ceramic body and the strap portion affixed to the rod end during said process; and providing means for attaching portions of the strap to said ceramic body.

15. A process as described in claim 14 whereby the step of providing said ceramic electrode body includes providing a body having an opening therein and further includes disposing at least a portion of said subassembly within said opening with the rod end having the strap affixed thereto spaced apart from an interior surface on the bottom of the opening.

16. A process as described in claim 15 whereby the step of providing said subassembly includes providing a subassembly having said metal strap in a "U" shape with the legs of the U projecting upwardly around the conductor rod.

17. A process as described in claim 14 whereby the step of providing said ceramic electrode body includes providing a body having a portion for attachment to the strap, said body portion having a free metal or metal alloy therein.

18. A process as described in claim 17 whereby said step of providing attaching means is providing a metal bond connection.

19. A process as described in claim 17 whereby said step of providing attaching means is providing a weld.

20. A process as described in claim 17 whereby the step of providing a body having a portion for attachment to the strap includes providing a chemically reduced portion of said ceramic body.

21. A process as described in claim 17 whereby the step of providing a body portion having a free metal or metal alloy therein includes providing a free metal or metal alloy selected from the group consisting of Fe, Ni, Al, Mg, Ca, Co, Sn, Ti, Cr, Mn, Zr, Cu, Nb, Ta, Li, Y, Pt, Pd and Ir.

22. A process as described in claim 17 whereby the step of providing said ceramic electrode body includes providing a ceramic electrode body having at least one metal oxide therein.

23. A process as described in claim 22 whereby the step of providing a ceramic electrode body having at least one metal oxide therein includes providing a body portion having a chemically reduced portion of said ceramic electrode body.

24. A process as described in claim 14 whereby the step of providing a ceramic body includes providing a ceramic electrode body having at least one metal compound comprised of at least two metal oxides.

25. A process as described in claim 24 whereby the step of providing a ceramic electrode body having at least one metal compound comprised of two metal oxides includes providing a ceramic electrode body having a chemically reduced portion.

* * * * *